US006343846B1

(12) United States Patent
Asano

(10) Patent No.: US 6,343,846 B1
(45) Date of Patent: Feb. 5, 2002

(54) INK JET PRINTING APPARATUS CAPABLE OF PRINTING IN THE SAME QUALITY REGARDLESS OF SHEET TYPE

(75) Inventor: Masaki Asano, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/033,362

(22) Filed: Mar. 2, 1998

(30) Foreign Application Priority Data

Mar. 5, 1997 (JP) ..... 9-050574

(51) Int. Cl.[7] ..... B41J 29/38; B41J 2/06
(52) U.S. Cl. ..... 347/14; 347/6; 347/55
(58) Field of Search ..... 347/6, 47, 55, 347/14, 9, 43, 15, 10

(56) References Cited

U.S. PATENT DOCUMENTS 4,604,654 A * 8/1986 Sakurada et al. ..... 347/15 X
5,231,427 A * 7/1993 Ohashi ..... 347/55
5,252,992 A * 10/1993 Fukushima et al. ..... 347/43
5,594,476 A * 1/1997 Tokunaga et al. ..... 347/10
5,745,131 A * 4/1998 Kneezel et al. ..... 347/15
5,786,831 A * 7/1998 Fukushima et al. ..... 347/43
5,889,538 A * 3/1999 Kishimoto et al. ..... 347/43
5,907,332 A * 5/1999 Fujita et al. ..... 347/43 X
6,102,507 A * 8/2000 Yoshida ..... 347/6

FOREIGN PATENT DOCUMENTS

| | | |
|---|---|---|
| JP | 54-133338 | * 10/1979 |
| JP | 62-32069 | * 2/1987 |
| JP | 62-267150 | * 11/1987 |
| JP | 3-213345 | * 9/1991 |
| JP | 4-33470 | * 2/1992 |
| JP | 4-361052 | * 12/1992 |
| JP | 6-226963 | * 8/1994 |
| JP | 7-81143 | 3/1995 |
| JP | 7-89157 | 4/1995 |

* cited by examiner

*Primary Examiner*—Susan S. Y. Lee
(74) *Attorney, Agent, or Firm*—Sidley Austin Brown & Wood

(57) ABSTRACT

In order to provide an ink jet printer achieving a constant printing quality regardless of the type of sheet to be used, a switch for selecting the type of sheet for the printer is provided. The type of sheet to be used is determined according to the state of the switch. Based on the result of the determination, the diameter of an ink drop emitted from a nozzle is changed. Since the degree of spreading of ink as well as the degree of absorption of ink differ depending on the type of sheet, the image quality after printing can be made constant regardless of the type of sheet by changing the diameter of ink drops.

30 Claims, 18 Drawing Sheets

FIG. 8

| GRADIENT | | 8 | 7 | 6 | 5 | 4 | 3 | 2 | 1 |
|---|---|---|---|---|---|---|---|---|---|
| INK DROP DIAMETER | | 55 | 51 | 47 | 43 | 38 | 33 | 27 | – |
| DOT DIAMETER | PAPER A (GLOSSY FILM) | 98 | 87 | 76 | 65 | 54 | 43 | 32 | – |
| | PAPER B (MATTE PAPER) | 113 | 100 | 87 | 75 | 62 | 49 | 36 | – |
| | PAPER C (PLAIN PAPER) | 134 | 113 | 98 | 85 | 70 | 55 | 41 | – |

UNIT : [μm]
INK VISCOSITY : 2.5 [mPa·s]
SURFACE TENSION : 30 [mN/m]

1 1 1 1
1 1
1 1

PAPER A,B
55 μm DROP
PAPER C
47 μm DROP

FIG. 11A
| | | | |
|---|---|---|---|
| 1 | 1 | 1 | 1 |
| 1 | 1 | 1 | 1 |
| 1 | 1 | 1 | 1 |
| 1 | 1 | 1 | 1 |
FIG. 11B
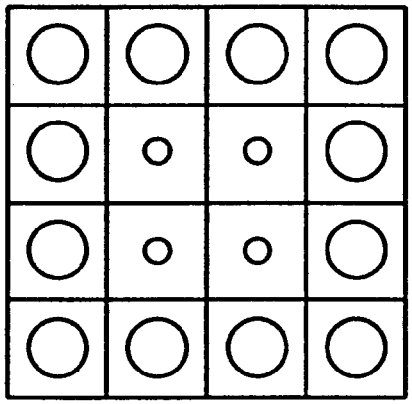
FIG. 11C
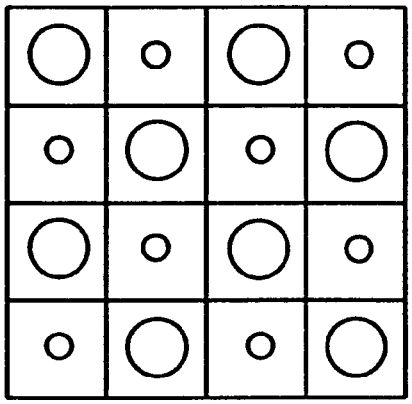

FIG. 17

| GRADIENT BEFORE CONVERSION | 8 | 7 | 6 | 5 | 4 | 3 | 2 | 1 |
|---|---|---|---|---|---|---|---|---|
| PAPER A MODE | 8 | 7 | 6 | 5 | 4 | 3 | 2 | 1 |
| PAPER B MODE | 7 | 6 | 5 | 4 | 3 | 2 | "A" | 1 |
| PAPER C MODE | 6 | 5 | 4 | 3 | 2 | "B" | "C" | 1 |

"A" : EMIT INK DROP OF DIAMETER(27 μm) CORRESPONDING TO GRADIENT 2 WITH A PROBABILITY OF 1/2
"B" : EMIT INK DROP OF DIAMETER(27 μm) CORRESPONDING TO GRADIENT 2 WITH A PROBABILITY OF 2/3
"C" : EMIT INK DROP OF DIAMETER(27 μm) CORRESPONDING TO GRADIENT 2 WITH A PROBABILITY OF 1/3

FIG. 18

| GRADIENT BEFORE CONVERSION | 8 | 7 | 6 | 5 | 4 | 3 | 2 | 1 |
|---|---|---|---|---|---|---|---|---|
| PAPER A MODE | 8 | 7 | 6 | 5 | 4 | 3 | 2 | 1 |
| PAPER B MODE | 7 | 7 | 6 | 5 | 4 | 3 | 2 | 1 |
| PAPER C MODE | 6 | 6 | 5 | 5 | 4 | 3 | 2 | 1 |

FIG. 19

| GRADIENT BEFORE CONVERSION | 8 | 7 | 6 | 5 | 4 | 3 | 2 | 1 |
|---|---|---|---|---|---|---|---|---|
| PAPER C MODE | 6 | "D" | 5 | "E" | 4 | 3 | 2 | 1 |

"D" : PUT DOT CORRESPONDING TO GRADIENT 6 WITH A PROBABILITY OF 1/2,
PUT DOT CORRESPONDING TO GRADIENT 5 WITH A PROBABILITY OF 1/2

"E" : PUT DOT CORRESPONDING TO GRADIENT 5 WITH A PROBABILITY OF 1/2,
PUT DOT CORRESPONDING TO GRADIENT 4 WITH A PROBABILITY OF 1/2,

INK JET PRINTING APPARATUS CAPABLE OF PRINTING IN THE SAME QUALITY REGARDLESS OF SHEET TYPE

BACKGROUND OF THE INVENTION

1. Field of the Invention

The present invention relates to an ink jet printing apparatus, and particularly to an ink jet printing apparatus which can change the diameter of a dot.

2. Description of the Related Art

This application is based on Japanese Patent Application No. 9-050574 filed in Japan, the contents of which is hereby incorporated by reference.

An ink jet printer (ink jet printing apparatus) has been known which changes the diameter of a dot to be printed by controlling the amount of ink emitted from a nozzle.

However, such an ink jet printer has problems as below.

(1) First Problem

Even if the same amount of ink is emitted, the diameter of a dot to be printed becomes large or small depending on the type of sheet on which printing is done.

(2) Second Problem

If printing is done on an OHP film, for example, much time is required for ink to dry compared with the normal type of paper. The conventional printer prunes dots to be printed in order to quickly dry the ink in such a case.

In order to carry out the process of pruning dots, the printer needs its own process of changing threshold value in error diffusion process or of pruning dots in a solid image (including characters). If the dither method is employed, separate look up tables are required for a case of pruning dots and a case of not pruning dots.

The necessity for the printer to have its own process for pruning dots in an image results in a complicated printing process done by an ink jet printer.

SUMMARY OF THE INVENTION

The present invention is made to solve such problems. The first object of the invention is to provide an ink jet printing apparatus which prints dots having an almost constant diameter regardless of the type of sheet to be printed.

The second object of the invention is to provide an ink jet printing apparatus which can speed up drying of ink adhering to a sheet by a simple process.

In order to achieve the objects above, an ink jet printing apparatus according to one aspect of the invention that can control an amount of ink emitted from a nozzle includes; a determining unit for determining readiness of drying of ink on recording media; and a controller which controls an amount of ink emitted from the nozzle by converting gradient of image data based on the determined readiness of drying of ink.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 is provided for describing a relation of the gradient of input data, the diameter of an ink drop emitted, and the diameter of a dot which has adhered to a sheet.

FIGS. 11A–11C are provided for describing ink drops emitted according to the second embodiment.

FIG. 17 shows a conversion table of gradient according to the fourth embodiment.

FIG. 18 shows the first modification of the conversion table of FIG. 17.

FIG. 19 shows the second modification of the conversion table of FIG. 17.

DESCRIPTION OF THE PREFERRED EMBODIMENTS

First Embodiment

Figure 1:
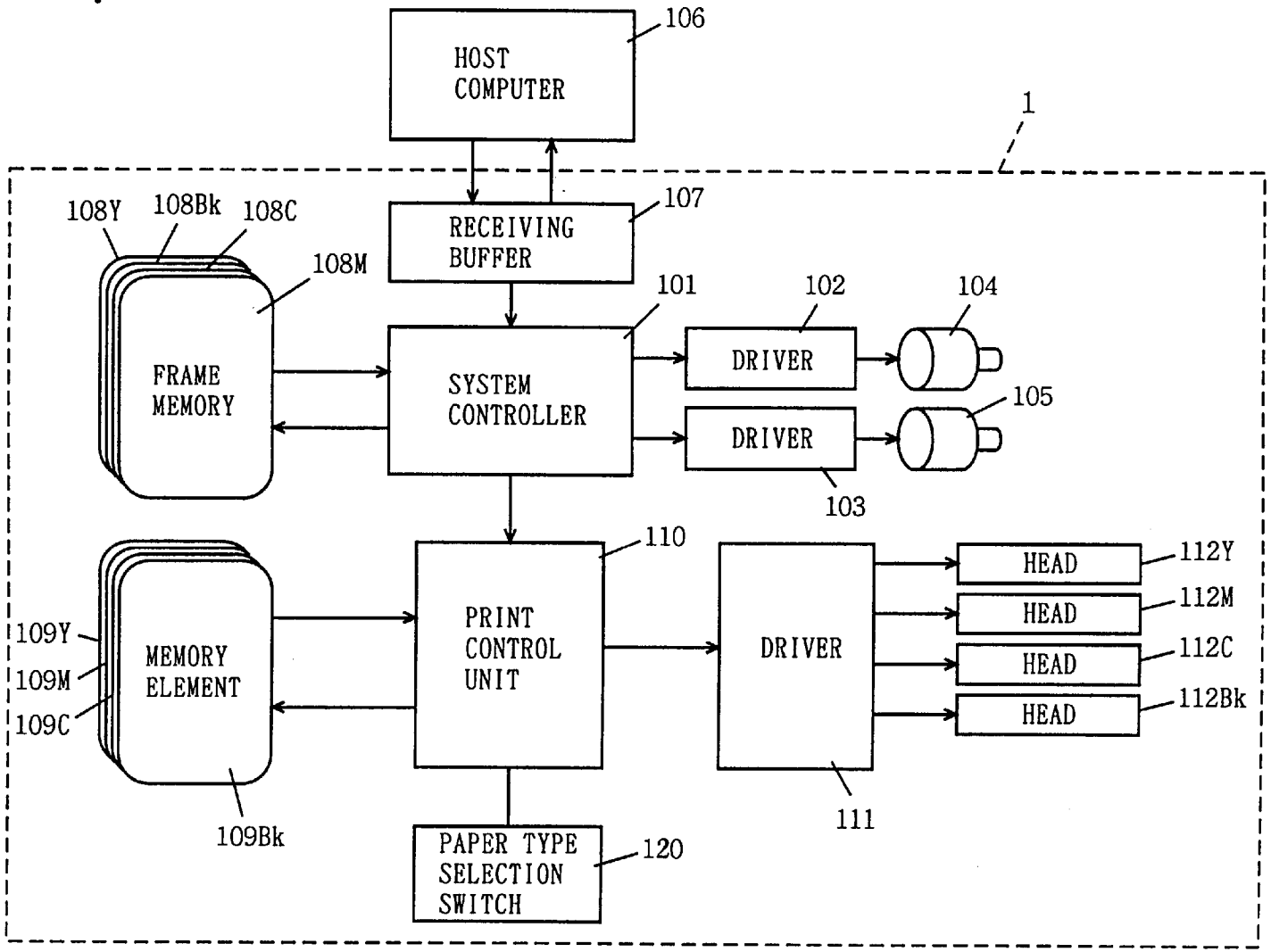
FIG. 1 is a block diagram showing a structure of an ink jet printer according to the first embodiment of the invention.

FIG. 1 is a block diagram illustrating a structure of an ink jet printer according to the first embodiment of the invention.

Referring to FIG. 1, an ink jet printer 1 includes: a system controller 101 which controls the entire apparatus; drivers 102 and 103 driving motors 104 and 105; motors 104 and 105 for moving a sheet to be printed and moving an ink jet head; a receiving buffer 107 for communication of print data with a host computer 106; frame memories 108Y, 108Bk, 108C, 108M temporarily storing image data for executing image processing of received image data; memory elements 109Y, 109M, 109C, 109Bk storing image data to be printed; a print control unit 110 controlling printing; a driver 111 for driving the ink jet head; ink jet heads 112Y, 112M, 112C and 112Bk for emitting yellow ink, magenta ink, cyan ink, and black ink respectively; and a paper type selection switch 120 for selecting the type of a sheet used by a user.

Receiving buffer 107 is connected to host computer 106. Ink jet printer 1 produces a print according to a print request signal and image data from host computer 106.

The frame memories include four planes 108Y, 108Bk, 108C and 108M in which image data corresponding to respective colors of yellow, black, cyan and magenta are stored. Similarly, the memory elements include four planes 109Y, 109M, 109C and 109Bk.

The user inputs the type of sheet used for printing using paper type selection switch 120. Specifically, the user can arbitrarily select one of glossy film, matte paper (paper with silica coating having a high ink absorption) and plain paper as a type of sheet to be used. A mode when the glossy film is selected, a mode when the matte paper is selected, and a mode when the plain paper is selected are herein respectively referred to as paper A mode, paper B mode, and paper C mode.

Figure 2:
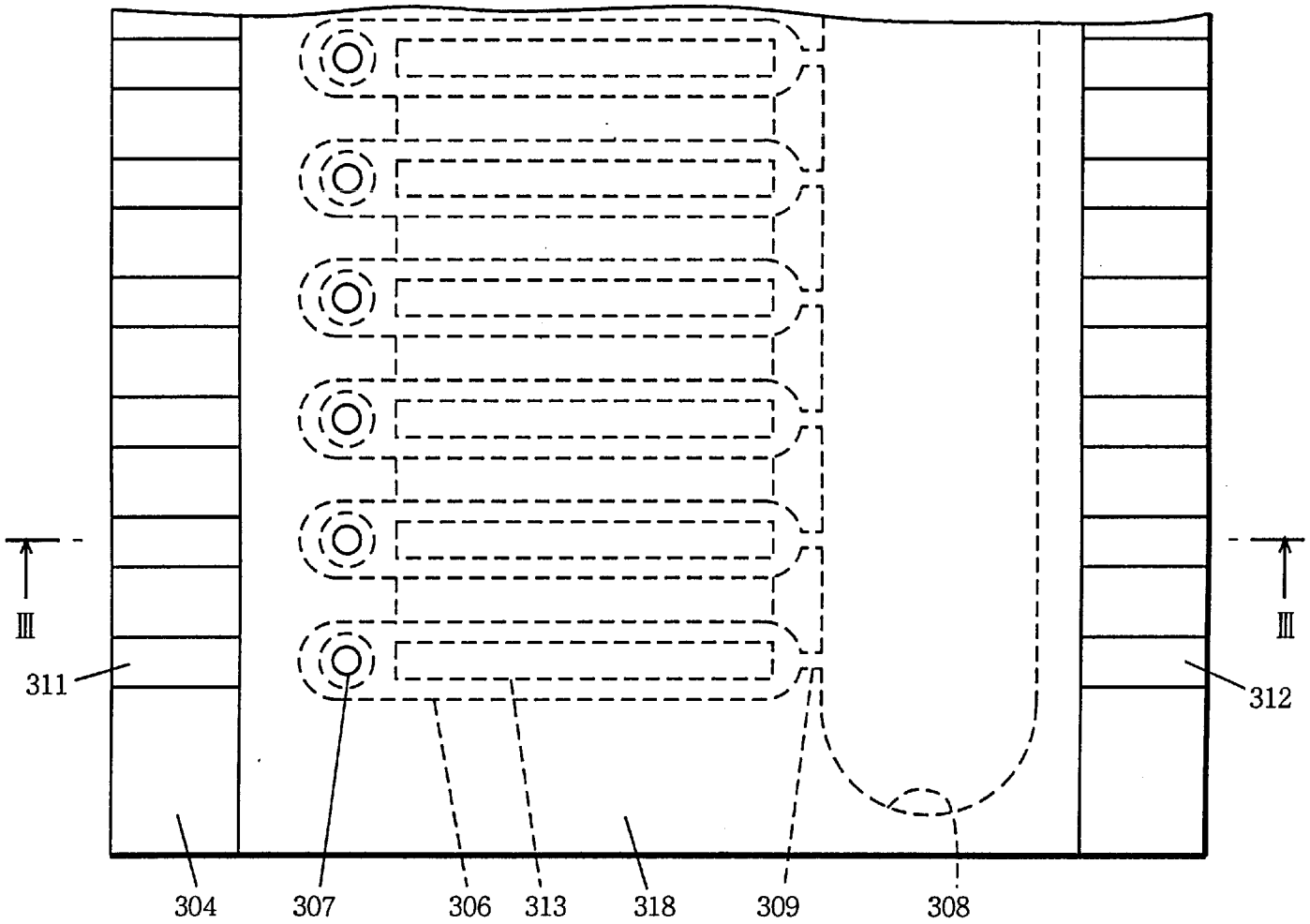
FIG. 2 is a plan view of an ink jet head.
Figure 3:
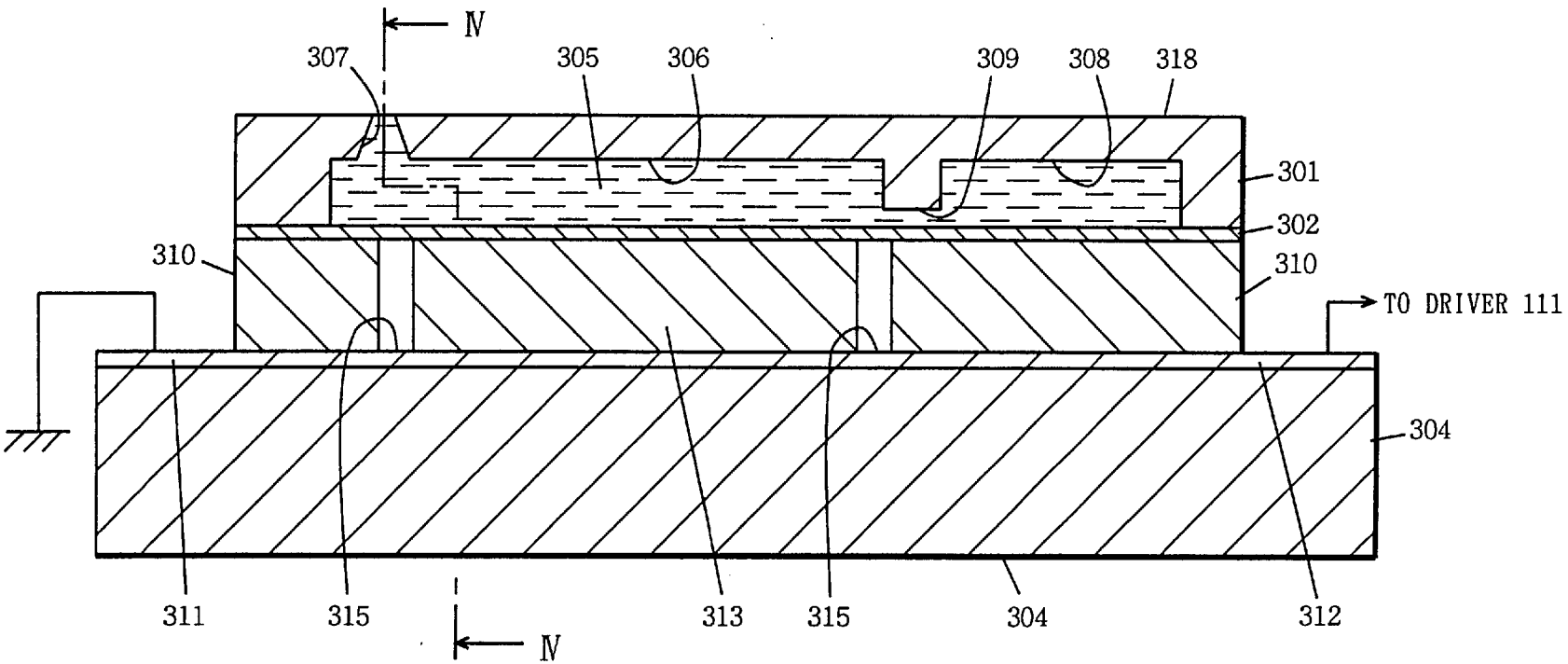
FIG. 3 is a cross sectional view along III—III of FIG. 2.
Figure 4:
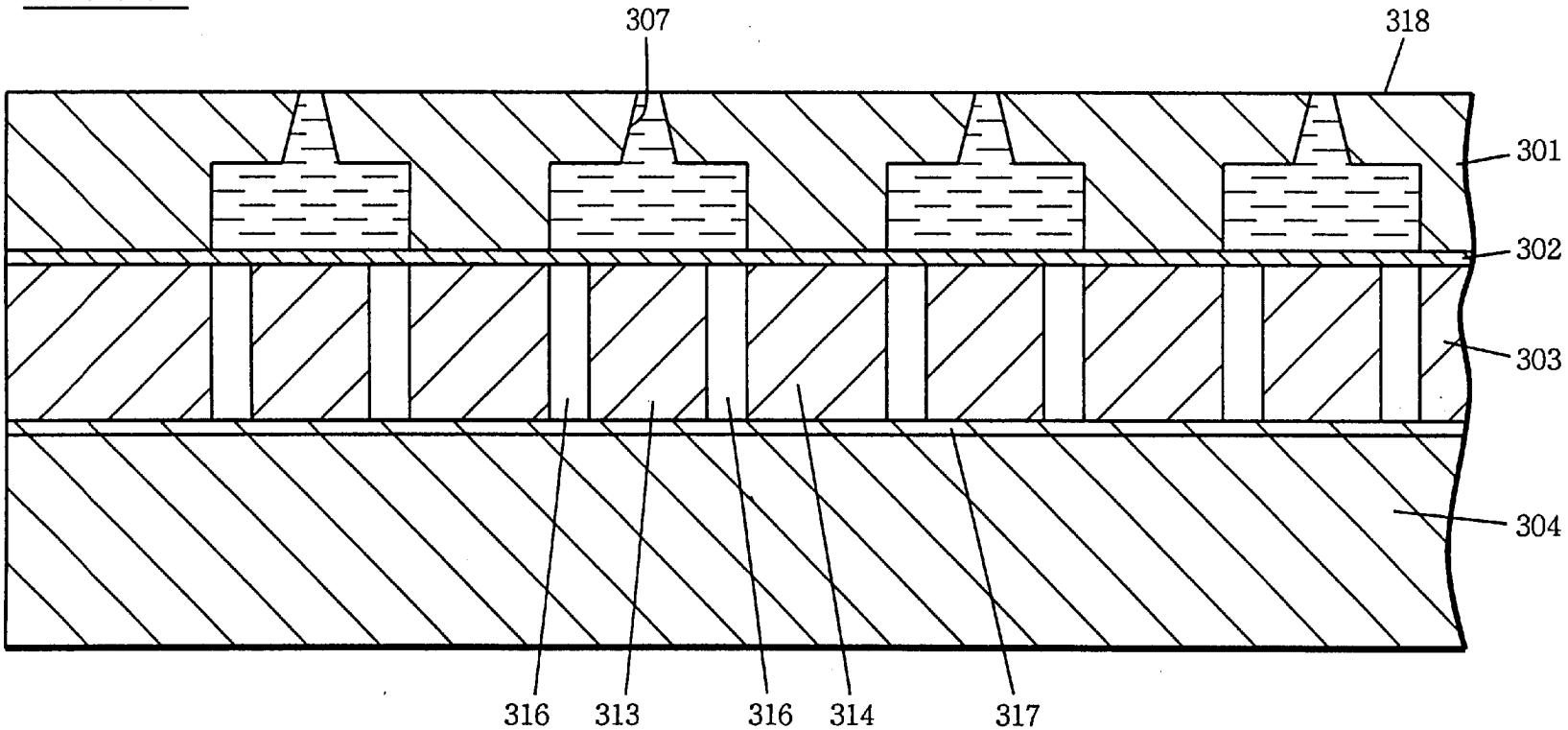
FIG. 4 is a cross sectional view along IV—IV of FIG. 3.

FIGS. 2–4 are provided for describing one of ink jet heads 112Y, 112M, 112C and 112Bk of FIG. 1.

FIG. 2 is a plan view showing a surface provided with a nozzle of the ink jet head, FIG. 3 is a cross sectional view along III—III line of FIG. 2, and FIG. 4 is a cross sectional view along IV—IV line of FIG. 3.

With reference to the figures, ink jet heads 112Y, 112M, 112C and 112Bk each has a structure formed of a nozzle plate 301, a bulkhead 302, a diaphragm 303 and a base plate 304 that are integrally layered on one another.

Nozzle plate 301 is formed of metal or synthetic resin and includes a nozzle 307. Nozzle plate 301 is provided with an ion-repellent layer at its surface 318. A thin film is used for bulkhead 302. Bulkhead 302 is fixed between nozzle plate 301 and diaphragm 303.

A plurality of ink channels 306 in which ink 305 is contained, and an ink inlet 309 which couples each ink channel 306 to an ink supply chamber 308 are formed between nozzle plate 301 and bulkhead 302. Ink supply chamber 308 is connected to an ink tank (not shown), and the ink within supply chamber 308 is supplied to ink channel 306.

Diaphragm 303 includes a plurality of piezoelectric elements 313 corresponding to respective ink channels 306. Diaphragm 303 is processed first by fixing diaphragm 303 to base plate 304 having a wiring portion 317 with insulating adhesive, and forming separate grooves 315 and 316 to divide diaphragm 303 by dicing.

The diaphragm 303 is divided into a separate piezoelectric element 313 corresponding to each ink channel 306, piezoelectric element column portion 314 located between adjacent piezoelectric elements 313, and a wall 310.

Wiring portion 317 on base plate 304 includes a wiring portion on common electrode side 311 connected to the earth and connected commonly to all piezoelectric elements 313 in ink jet heads 112Y, M, C and Bk, as well as a wiring portion on separate electrode side 312 separately connected to each piezoelectric element 313 in ink jet heads 112Y, M, C and Bk. Common electrode side wiring portion 311 on base plate 304 is connected to a common electrode in piezoelectrode element 313, and separate electrode side wiring portion 312 thereon is connected to a separate electrode in piezoelectric element 313.

The operation of the ink jet head having such a structure is controlled by print control unit 110 of the ink jet printer. When a signal is supplied from print control unit 110 to driver 111, driver 111 applies a prescribed voltage which is a print signal between the common electrode and the separate electrode provided in piezoelectric element 313. Accordingly, the piezoelectric element 313 is deformed in a direction of pressing bulkhead 302. The deformation of piezoelectric element 313 is transmitted to bulkhead 302. Ink 305 within ink channel 306 is thus pressurized. An ink drop accordingly travels toward a sheet via nozzle 307.

An amount of ink emitted from the nozzle for printing one dot is controlled by changing an amount of voltage applied to piezoelectric element 313 or changing a time for applying the voltage.

Figure 20:
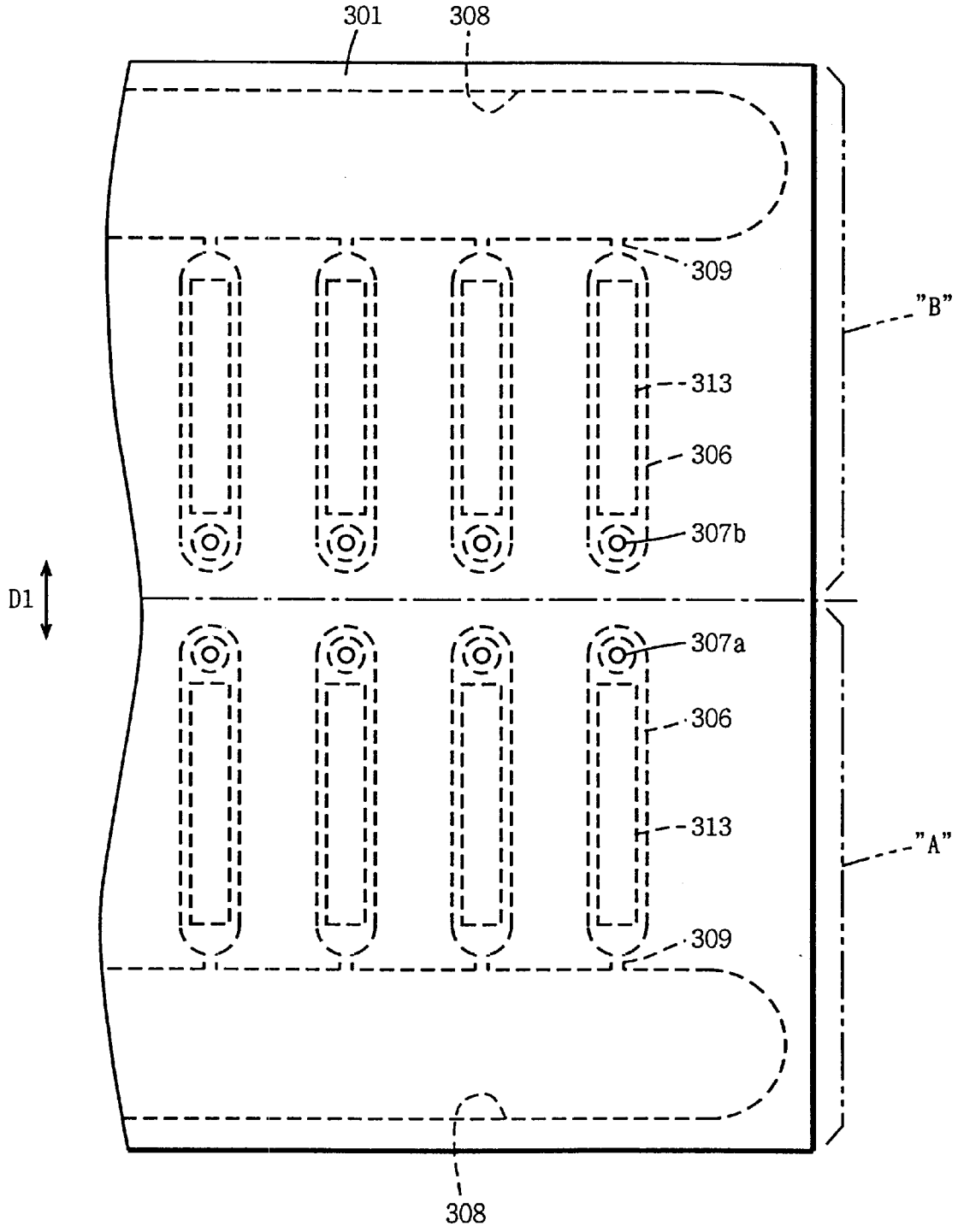
FIG. 20 shows a modification of the ink jet head.

According to this embodiment, an amount of ink is controlled by changing an amount of voltage applied to piezoelectric element 313 or changing a time for applying the voltage. However, an amount of ink used for printing one dot may be controlled by using two or more nozzles having different diameters. A specific example of such an ink jet head is shown in FIG. 20. Two heads of FIG. 2 are symmetrically arranged with diameters of nozzles 307*a* and 307*b* changed.

An amount of ink emitted from a nozzle having a larger diameter is larger than that emitted from a nozzle having a smaller diameter.

In addition, an amount of ink emitted from each of nozzles having different diameters may be controlled. In this case, a region in which diameters of adhering dots are controlled increases to improve gradation.

Figure 5:
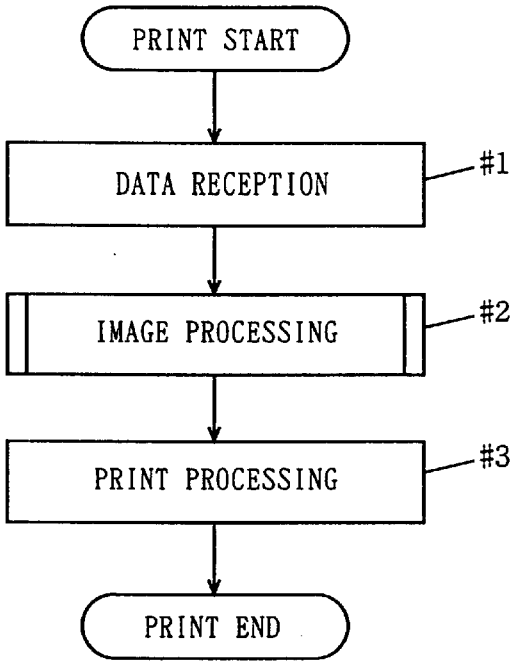
FIG. 5 is a flow chart showing a main routine of a printing process by the ink jet printer of FIG. 1.

FIG. 5 is a flow chart showing printing operation by the ink jet printer of FIG. 1.

Referring to FIG. 5, receiving buffer 107 receives a print request signal and data to be printed from host computer 106 in step #1.

In step #2, system controller 101 executes image processing of the received image data using frame memories 108Y, 108Bk, 108C and 108M.

In step #3, image data to which the image processing has been applied is stored in memory elements 109Y, 109M, 109C and 109Bk via print control unit 110. The stored image data is transferred to ink jet heads 112Y, 112M, 112C and 112Bk via print control unit 110 and driver 111. An image is accordingly formed on a sheet.

Figure 6:
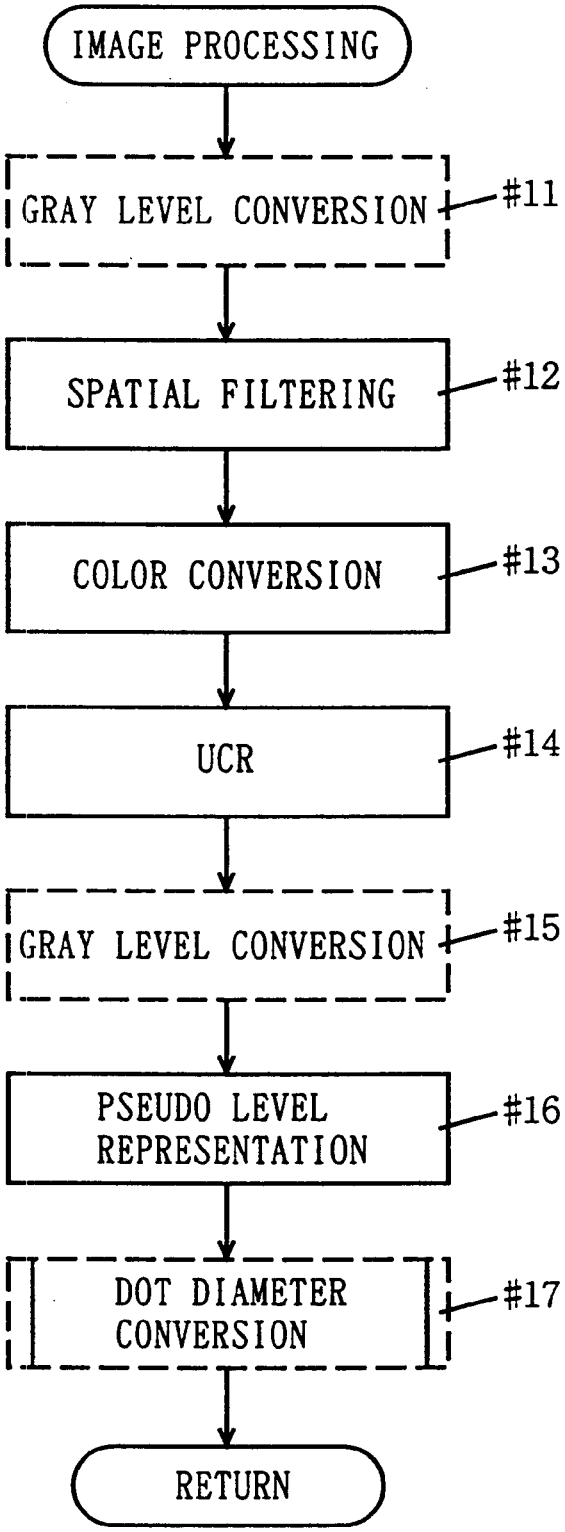
FIG. 6 is a flow chart showing processes of the image processing routine (#2) of FIG. 5.

FIG. 6 is a flow chart showing image processing routine (#2) of FIG. 5.

Referring to FIG. 6, gray level conversion is carried out in step #11. The gray level conversion is a process of converting data from an input source such that a preferable tone reproduction is achieved according to the input source.

In step #12, spatial filtering is executed. The spatial filtering is a process for correcting degradation in sharpness to clearly represent an image. The sharpness of an input source is generally degraded due to various factors. It is not preferable to print with such degradation remaining. Further, information having a high spatial frequency could be degraded when dither process is carried out. The spatial filtering is employed for avoiding such a problem.

In step #13, color conversion is carried out. The color conversion is a process of converting color such that data obtained from the input source matches with coloring material supplied from the printer. Specifically, conversion from RGB data which has undergone the gray level conversion to CMY data by reversal of the RGB data as well as conversion for achieving a preferable color reproduction according to characteristics of the color of the input source are carried out.

In step #14, UCR (Under-Color Removal) process is carried out. The UCR is a process of replacing ink of YMC with an equivalent amount of black ink in order to reduce an amount of ink and to enhance contrast. As a process of supplying the black ink, there is a skeleton black process of supplying black (K) only to a portion having high density, and a full black process of supplying black to the entire region.

The gray level conversion is carried out in step #15, and pseudo level representation is applied based on the result in step #16. The pseudo level representation is conversion according to the dither method or the error diffusion method.

By the pseudo level representation, a binary image which is shown by presence and absence of dots is obtained according to the first embodiment.

In step #17, the diameter of a dot is changed based on the type of sheet set by paper type selection switch 120 (see FIG. 1).

After the diameter of a dot of image data is changed, the process returns to the main routine.

Figure 7:
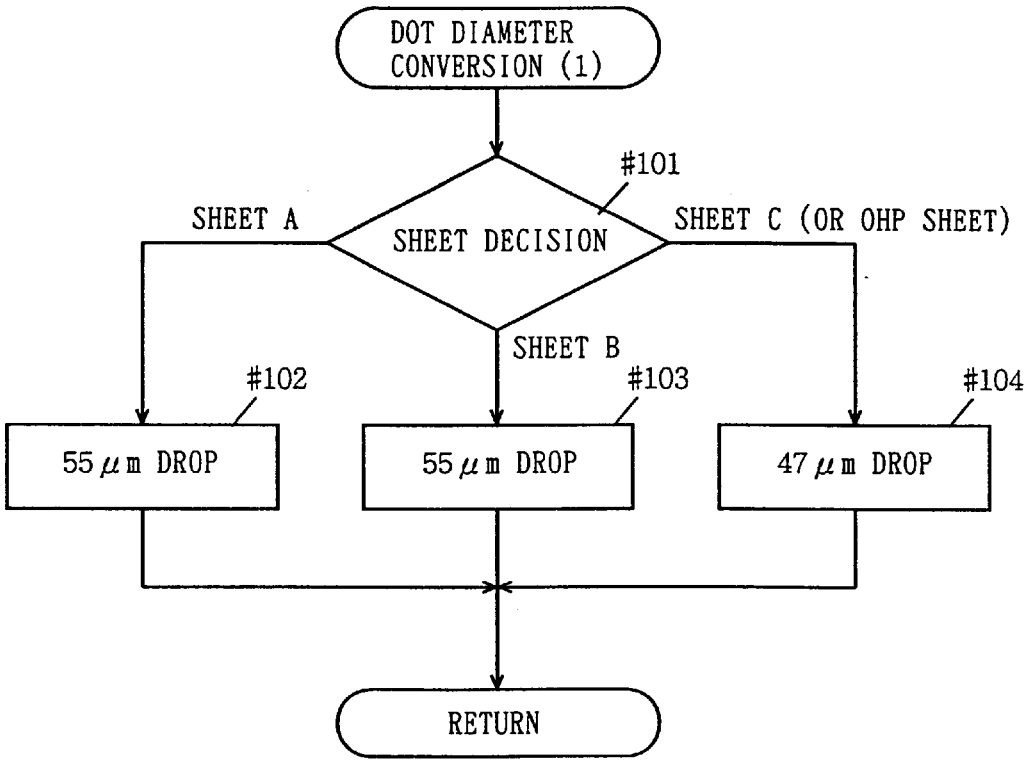
FIG. 7 is a flow chart showing processes of the dot diameter conversion process (#17) of FIG. 6.

FIG. 7 is a flow chart showing processes of dot diameter conversion process (#17) of FIG. 6.

Referring to FIG. 7, decision is made on which type of sheet is set by paper type selection switch 120 in step #101. If the set sheet type is the glossy film (sheet A), the diameter of a particle of ink emitted from nozzle 307 is set to 55 μm in step #102.

If it is determined that the matte paper (sheet B) is selected in step #101, the diameter of a particle of ink is similarly set to 55 μm in step #103.

If it is determined that the plain paper (sheet C) is selected in step #101, the diameter of a particle of ink emitted from nozzle 307 is set to 47 μm in step #104.

Following the processes above, the diameter of a particle of ink is set to 55 μm if the glossy film or the matte paper is used. On the other hand, if the plain paper is used, the diameter of a particle of ink is set to 47 μm. The reason for changing the diameter of a particle of ink according to the type of sheet is given below.

FIG. 8 shows a relation between the diameter of a particle of ink (ink drop diameter) emitted from the nozzle and the diameter of a dot (dot diameter) formed after the ink particle adheres to the paper. Referring to FIG. 8, the ink drop diameter is shown as 55, 51, 47, 43, 38, 33 and 27 (μm) respectively for gradients 8-2. If the gradient is 1, no ink drop is emitted. The larger the ink drop diameter, the larger the diameter of a printed dot. The diameter of a dot differs depending on the type of paper.

If the glossy film (paper A) is used, the diameter of a dot is 98, 87, 76, 65, 54, 43, 32 (μm) for the gradient in order of magnitude thereof with the greatest one as the first one. In other words, the dot diameter 98 corresponds to the greatest gradient and the dot diameter 32 corresponds to the smallest gradient. No dot is indicated when the gradient is 1.

If the matte paper (paper B) is used, the dot diameter is 113, 110, 87, 75, 62, 49, 36 (μm) for the gradient in order of magnitude with the greatest one as the first one.

If the plain paper (paper C) is used, the dot diameter is 134, 113, 98, 85, 70, 55, 41 (μm) for the gradient in order of magnitude with the greatest one as the first one.

The diameter of a printed dot differs depending on the type of paper and the material of a coating layer. The dot diameter on the paper A (98 μm) printed with ink for gradient of 8 (ink drop diameter 55 μm) is equal to the dot diameter on the paper C (98 μm) printed with ink for gradient of 6 (ink drop diameter 47 μm). Utilizing this feature, if the paper A is printed with dots, ink having an ink drop diameter of 55 μm is used, and if the paper C is printed, ink having an ink drop diameter of 47 μm is used according to the first embodiment. Dots of the same diameter can be printed regardless of the type of paper.

It is noted that the viscosity of the ink employed in FIG. 8 is 2.5 [mPa·s], and its surface tension is 30 [mN/m].

An effect obtained by this embodiment is described below.

Figures 9A, 9B, 9C, 9D, 9E:
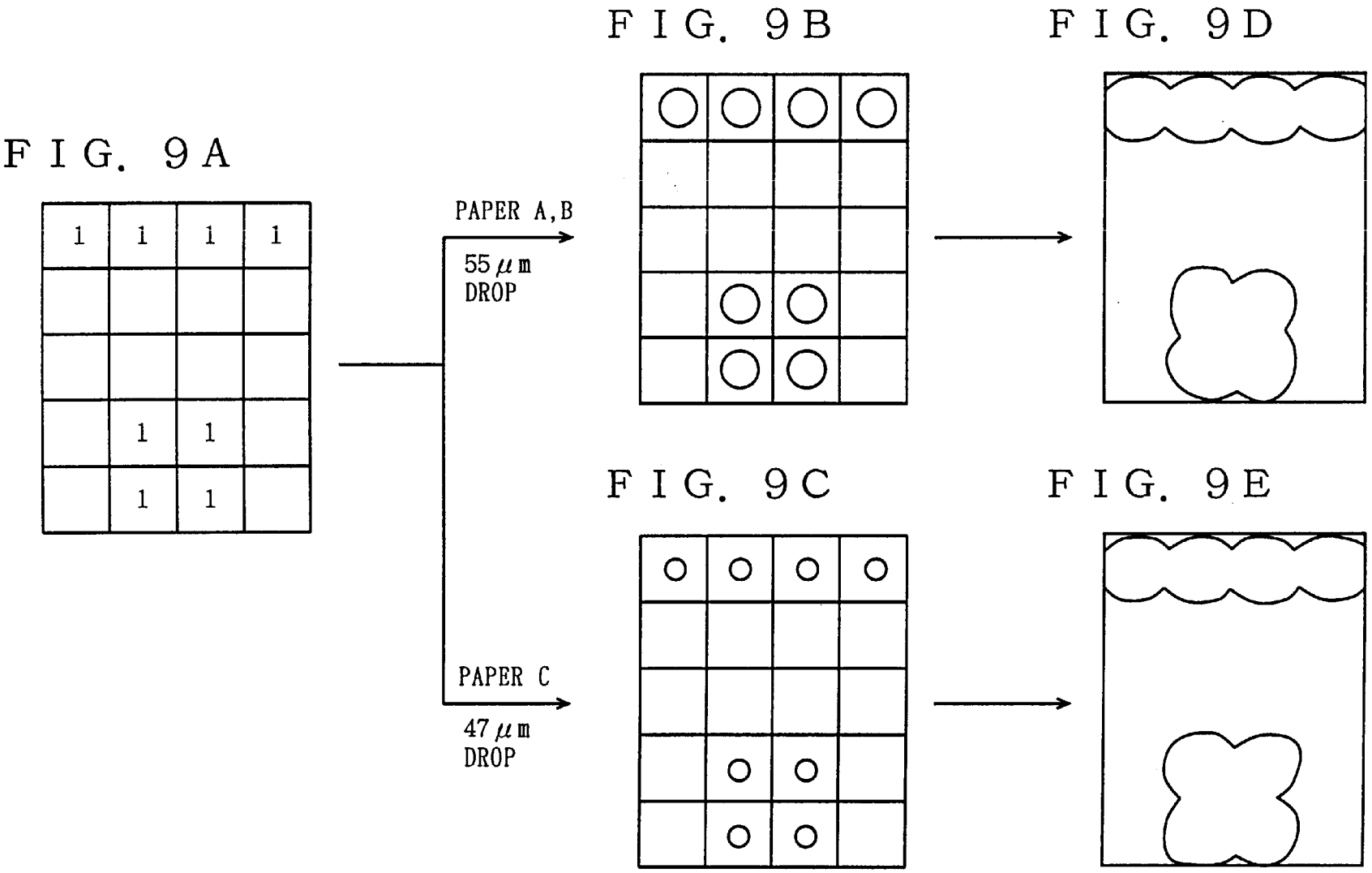
FIGS. 9A–9E are provided for describing an effect of the first embodiment.

Suppose that image data obtained by the pseudo level representation (#16) of FIG. 6 is the image data as shown in FIG. 9A. "1" indicates a location where a dot is to be put. If the paper A or B is selected by paper type selection switch 120 (see FIG. 1), an ink drop with a diameter of 55 μm is emitted to the location where a dot is to be put as shown in FIG. 9B.

If the paper C is selected by paper type selection switch 120, an ink drop having a diameter of 47 μm is emitted to the location where a dot is to be printed.

If the paper A or B is used, an image shown in FIG. 9D is printed by changing the diameter of the ink drop as above. Although the paper C is printed with an ink drop having its diameter smaller than that for the papers A and B, an image almost similar to that of FIG. 9D is printed as shown in FIG. 9E. Equivalent images can be formed regardless of the type of paper.

According to the first embodiment, two kinds of ink drops having the diameters of 55 μm and 47 μm respectively are emitted from the ink jet head. However, ink drops of three or more sizes of the diameter may be emitted, for example, and the ink drops having different diameters may be emitted for many types of papers.

According to this embodiment, an advantageous effect that a complicated process is unnecessary in image processing is obtained, since the dot diameter is converted (#17) after image processing is carried out by the dither method and the error diffusion method (up to step #16) as shown in FIG. 6.

In addition, paper type selection switch 120 may select the OHP sheet. When the OHP sheet is selected, an ink drop having a diameter of 47 μm may be used as the case of sheet C of FIG. 7. In this case, the ink on the OHP sheet can be speedily dried. Although the appearance of the print on the OHP sheet shows an image of a low density, the image is naturally seen by human eyes when the image is actually projected by a projector onto the OHP sheet.

Second Embodiment

The hardware structure according to the second embodiment is the same as that according to the first embodiment, and description thereof is not repeated here.

Figure 10:
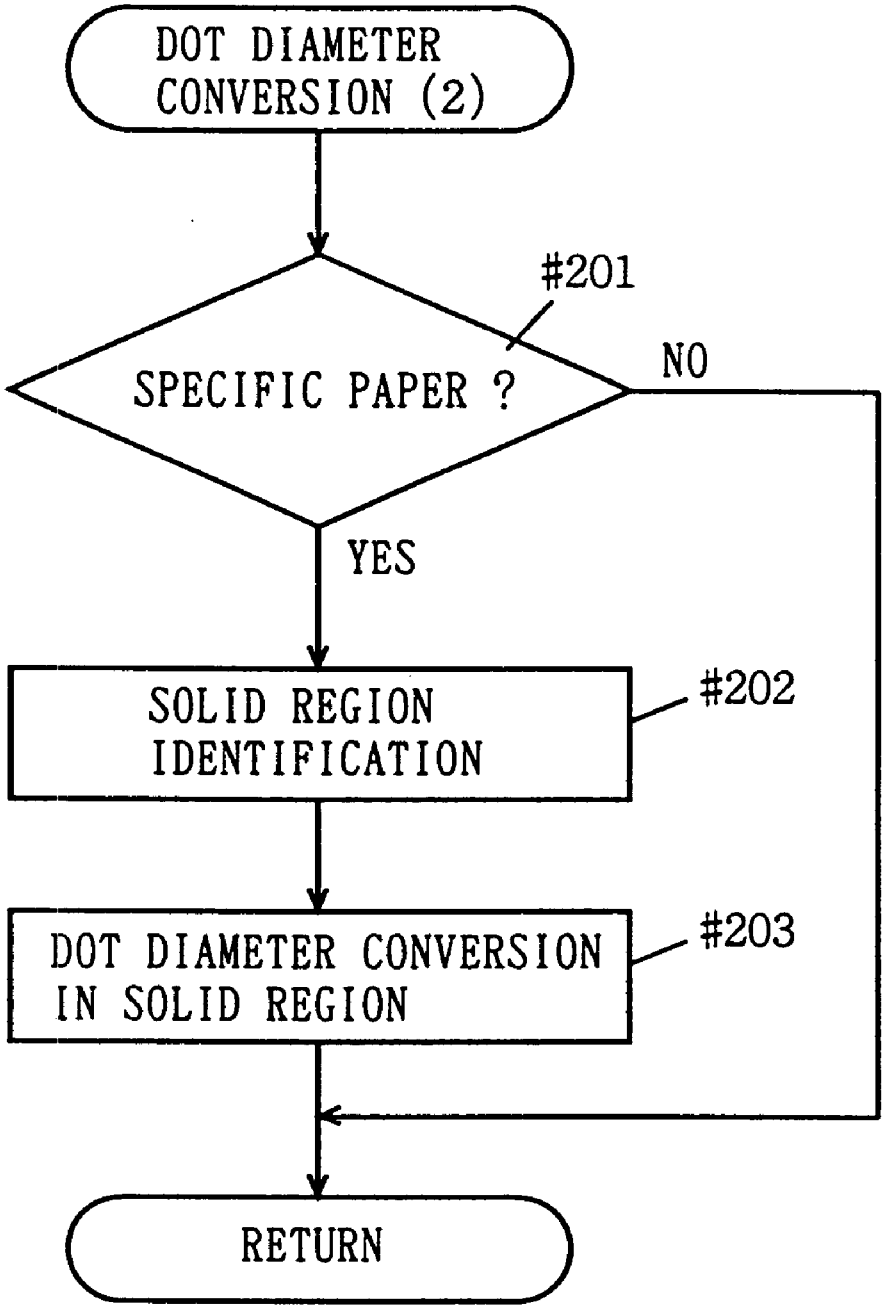
FIG. 10 is a flow chart showing a dot diameter conversion process according to the second embodiment.

According to the second embodiment, processes shown in FIG. 10 are carried out for the dot diameter conversion process (#17) of FIG. 6.

Referring to FIG. 10, it is determined that whether or not paper type selection switch 120 selected a specific sheet in step #201. The specific sheet refers to papers B and C, for example.

If the answer is YES in step #201, a solid region (where dots are successively put in vertical and horizontal directions) in image data is identified in step #202. At the same time, an outline of the solid region is identified.

For entirely painting a portion within the outline of the solid region with a prescribed interval therebetween (between the portion and the outline), the diameter of the dots is converted in step #203. By decreasing the diameter of the dots constituting the inside of the solid region, the amount of ink inside the solid region is reduced so that the ink readily dries.

If the answer is NO in step #201, the diameter of the dots in the solid region is not converted.

Referring to FIGS. 11A–11C, suppose that image data after the process of the pseudo level representation includes a solid image of 4×4 as shown in FIG. 11A. If it is determined that a specific sheet is used (YES in #201) in the dot diameter conversion process (FIG. 10), the solid region and its outline are identified, and the diameter of dots inside the outline is reduced (FIG. 11B). For example, if the dots in the outline portion is formed with ink drops having the diameter of 55 μm and the dots inside the outline portion is formed with the ink drops having the diameter of 47 μm, excessive supply of ink can be prevented.

In step #203, dots having a large diameter (dots formed with ink drops having the diameter of 55 μm) and dots of a small diameter (dots formed with ink drops having the diameter of 47 μm) may be arranged in a checker form as shown in FIG. 11C in a portion where the solid regions is identified. Such an arrangement can prevent excessive supply of ink.

Figure 12:
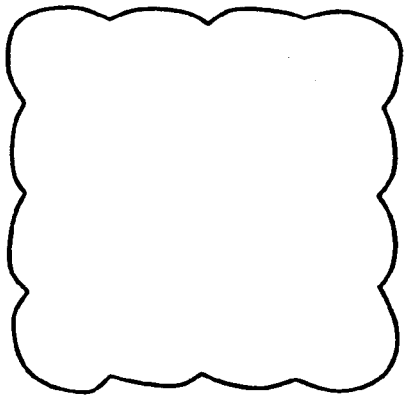
FIG. 12 is provided for describing an effect of the second embodiment.

When an image of the solid portion is formed as FIG. 11B or 11C, the solid image can be correctly reproduced by spreading of ink after the ink adheres to the sheet as shown in FIG. 12.

Third Embodiment

The hardware structure of an ink jet printer according to the third embodiment is similar to that according to the first embodiment, and description thereof is not repeated. The ink jet printer according to the third embodiment is used for printing a color image.

Figure 13:
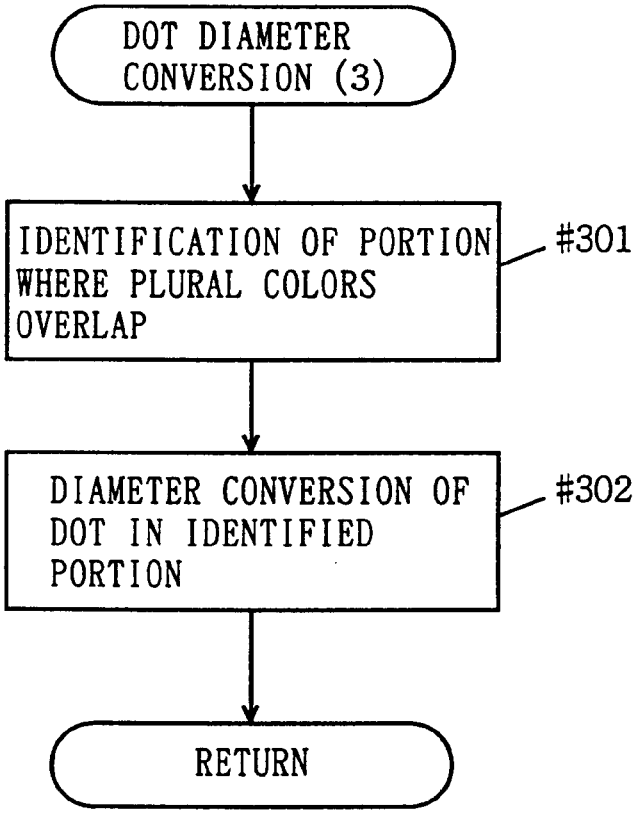
FIG. 13 is a flow chart showing a dot diameter conversion process according to the third embodiment.

According to the third embodiment, processes shown in FIG. 13 are carried out in the dot diameter conversion process (#17) of FIG. 6.

Referring to FIG. 13, a portion where a plurality of colors of ink overlap is identified in step #301. Specifically, three colors of yellow (Y), magenta (M) and cyan (C) are used for color printing, and a portion of a sheet which is printed with a plurality of colors of the ink is identified.

The diameter of dots used for the identified portion is reduced in step #302.

Since the portion where plural ink colors are overlapped with one another is supplied with excessive ink, the amount of ink applied to the portion is decreased to improve the easiness of drying of a sheet, or such that a sheet dries well.

Figure 14:
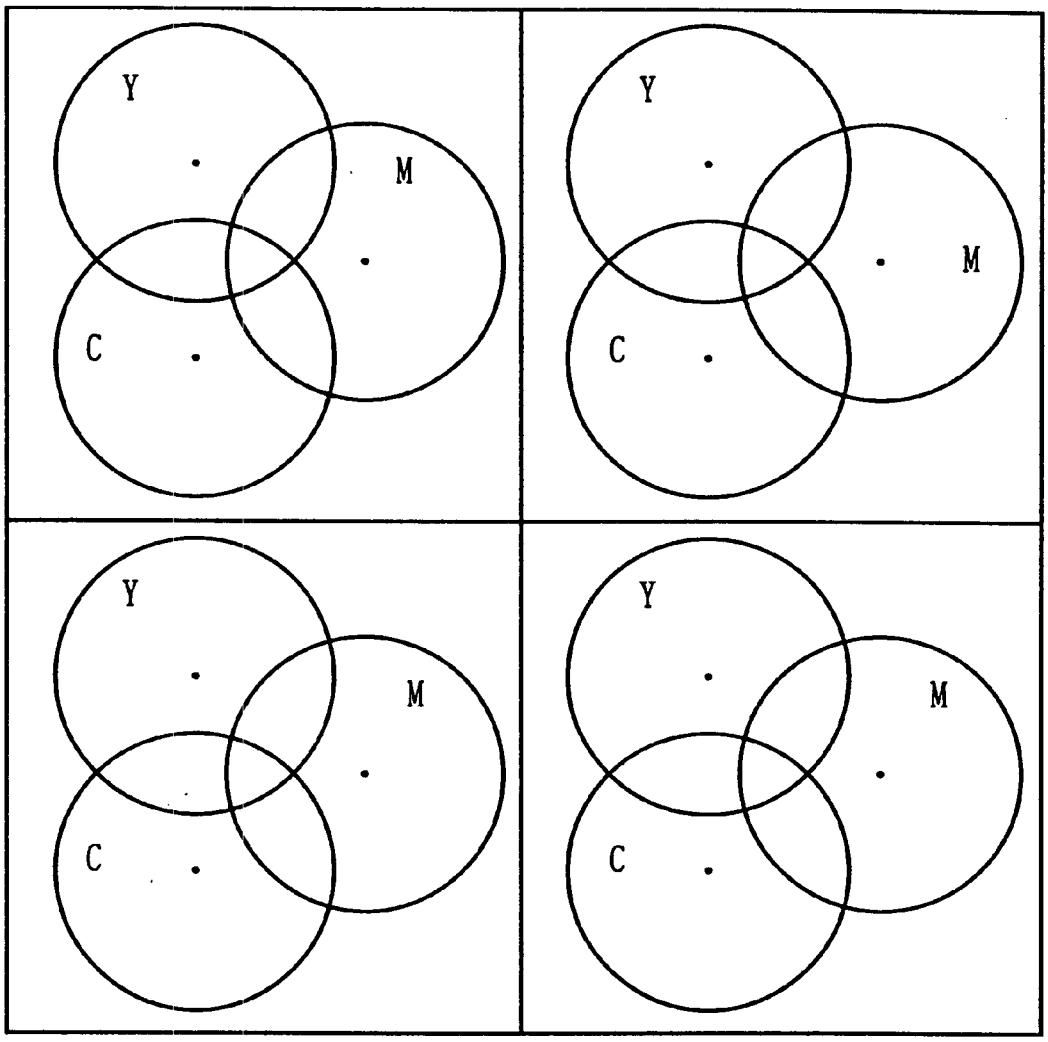
FIG. 14 is provided for describing a state in which dots of three colors are printed with ink drops having a large diameter.
Figure 15:
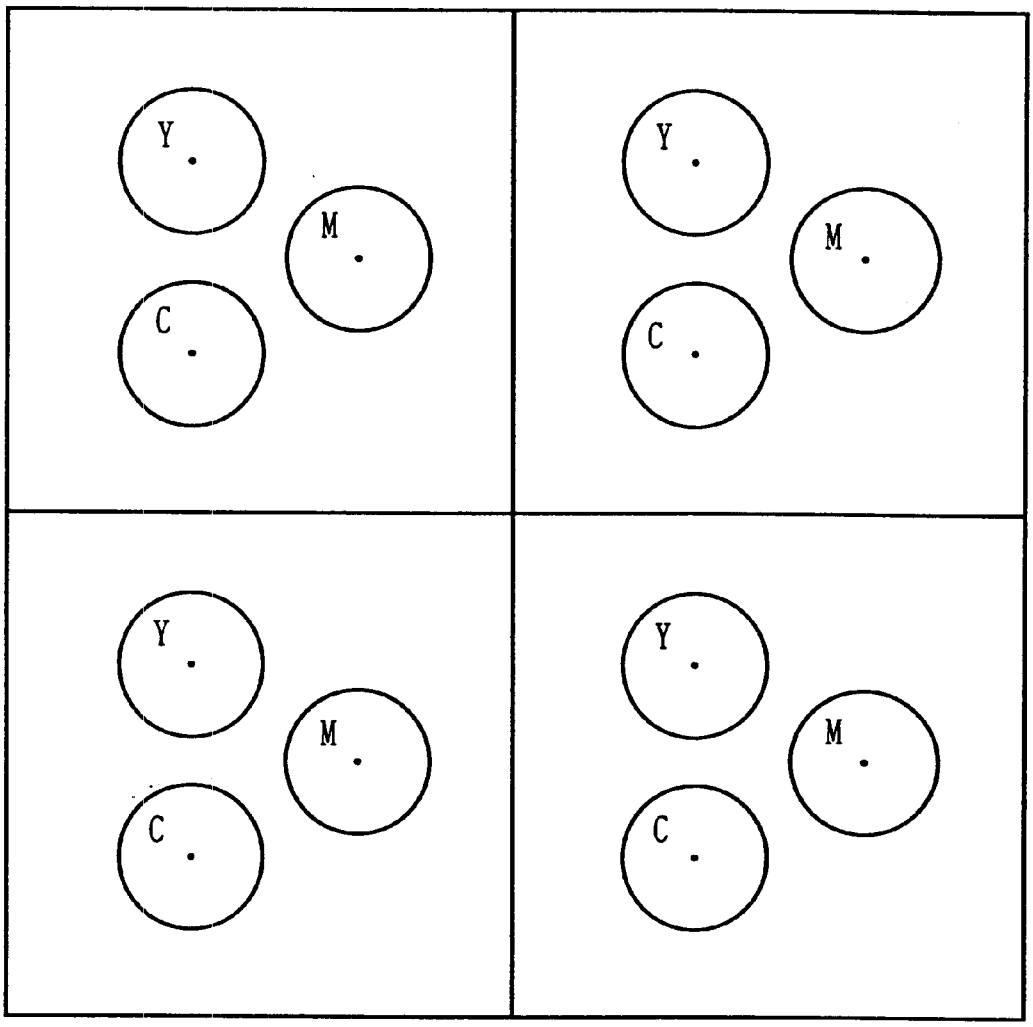
FIG. 15 is provided for describing an effect of the third embodiment.

Referring to FIG. 14, if plural colors (Y, M, C) of ink dots having the diameter of 55 μm for example are put on one after another, an excessive amount of ink tends to be supplied. According to this embodiment, the excessive supply of ink can be prevented by using dots of a small diameter (dots put with ink having an ink drop diameter of 47 μm for example) as shown in FIG. 15.

Fourth Embodiment

The hardware structure of an ink jet printer according to the fourth embodiment is similar to that according to the first embodiment, and the description thereof is not repeated here. According to the fourth embodiment, ink drops having their magnitude of seven stages can be emitted from the nozzle as shown in the portions of FIG. 8 corresponding to gradients 8-2, by changing the amount of voltage applied to the piezoelectric member of the ink jet head or changing a time for application of the voltage. As a result, seven kinds of diameters of the dots actually sticking to a paper can be obtained.

According to the fourth embodiment, gray level conversion is applied to image data of eight gradients in step #17, obtained according to the dither method or the error diffusion method carried out in steps #15 and #16 of FIG. 6.

Figure 16:
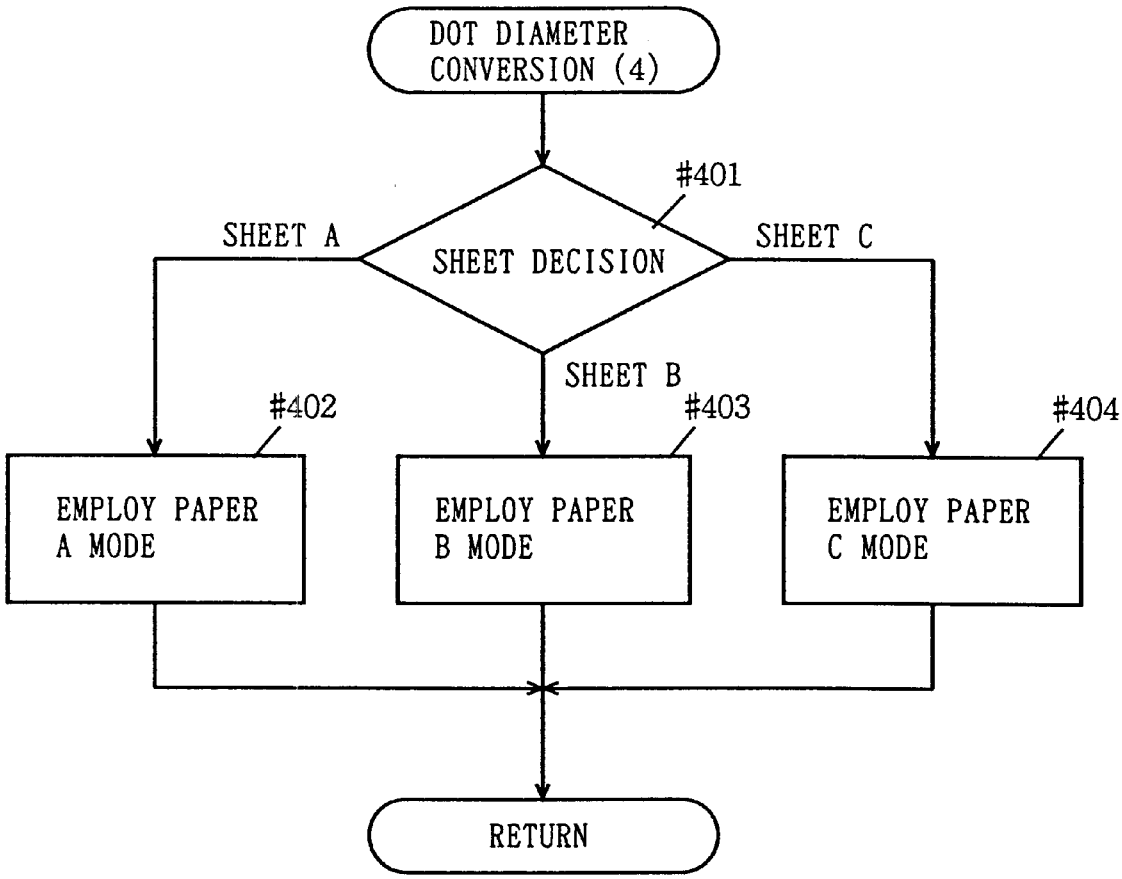
FIG. 16 is a flow chart showing a dot diameter conversion process according to the fourth embodiment.

FIG. 16 is a flow chart showing the dot diameter conversion process of step #17.

Referring to FIG. 16, the type of sheet is determined based on information from paper type selection switch 120 in step #401. If the result of determination shows that the sheet is paper A (glossy film), paper A mode is employed in step #402. If the paper type is paper B (matte paper), paper B mode is employed in step #403, and if the paper type is paper C (plain paper), paper C mode is employed in step #404.

FIG. 17 shows a gradient conversion table for each paper mode.

With reference to FIG. 17, when there are eight gradients 1–8 before conversion, gradient data is directly output as it is without converting the gradients if paper mode A is employed.

When there are gradients 3–8 before conversion, 1 is subtracted from the number of the gradient and the obtained gradient is output as the one after conversion if paper B mode is employed. When the gradient is 2 before conversion, conversion is applied such that ink drops having a drop diameter corresponding to gradient 2 (27 μm of FIG. 8) are emitted with a probability of ½. Accordingly, a gradient lower than gradient 2 in appearance is expressed. If the gradient before conversion is 1, the gradient is not changed since conversion is unnecessary for gradient 1 in which case ink drops are not emitted as shown in FIG. 8.

When there are gradients 4–8 before conversion, the gradient number after conversion is determined by subtracting 2 from each gradient if paper C mode is selected. When the gradient before conversion is 3, conversion is applied such that ink drops having the drop diameter corresponding to gradient 2 (27 μm) are emitted with a probability of ⅔. When the gradient before conversion is 2, conversion is carried out such that ink drops having the drop diameter corresponding to gradient 2 (27 μm) are emitted with a probability of ⅓. If the gradient before conversion is 1, no gradient conversion is carried out.

For "A", "B" and "C" in FIG. 17, ink drops are emitted on the basis of the probability. However, ink drops may be emitted in every one emission for "A". For "B", emission of ink drops may be controlled such that two ink drops are emitted and no ink drop is emitted in the next emission. For "C", ink drops may be emitted in every two emissions.

When the same ink drops are emitted to respective types of sheets, the diameters of dots sticking to the sheets varies depending on the sheet type. The largest one is for paper C, the smallest one is for paper A and the intermediate one is for paper B. According to this embodiment, the gradient is varied according to the type of sheet. An almost uniform diameter of the dot as well as an almost uniform image can be obtained when any type of sheet is used.

FIG. 18 shows a modification of the conversion table of FIG. 17.

Referring to FIG. 18, gradient conversion is not carried out when paper A mode is employed. When paper B mode is employed, gradient 8 before conversion is changed to gradient 7. When paper C mode is employed, gradient 8 or 7 before conversion is converted to gradient 6, and gradient 6 before conversion is changed to gradient 5. Other gradients are output as they are without conversion.

Such a conversion is carried out since the ink spreads over the paper after sticking thereto when paper B and paper C are used, and all pixels are filled with ink drops corresponding to gradient 7 on paper B. In the case of paper C, if ink drops corresponding to gradient 6 are emitted, a region of pixels corresponding to the dots is filled with the ink. Gradient 8 is thus unnecessary, and not used for paper B mode or paper C mode. Emission of wasteful ink can be prevented and application of excessive ink to the paper can be prevented by such a conversion. Further, the ink sticking to the sheet can be more readily dried.

FIG. 19 shows a modification of the conversion table for paper C mode. Referring to FIG. 19, gradients before conversion are 1–8.

When paper C mode is employed, gradient 8 before conversion is changed to gradient 6 for the reason described above. If the gradient is 7 before conversion, dots of gradient 6 are printed with a probability of ½ and dots of gradient 5 are printed with a probability of ½.

If gradient is 6 before conversion, the gradient is converted to 5.

If the gradient is 5 before conversion, dots of gradient 5 are printed with a probability of ½ and dots of gradient 4 are printed with a probability of ½ after conversion.

If gradients are 1–4 before conversion, no conversion is carried out.

Ink drops having a plurality of different diameters may be emitted with any probability for the middle tone. An image with a superior gradient can be printed by such a conversion.

According to the fourth embodiment, a desired table is selected according to paper type selection switch 120. However, gradient conversion may be carried according to the control ability of emission by the head and the γ characteristics selected by a user. The drop diameter may be controlled simultaneously such that the diameter of the drop is reduced for the region where plural colors of ink overlap as shown in the second and third embodiments.

According to the embodiment, the diameter of a dot sticking to the paper is controlled by changing the diameter of the ink drops. However, when the diameter of the dots is changed by overlapping of drops of small diameter one after another as the continuous type, the gradient can be controlled if the amount of ink is controlled by changing the number of overlaps of drops.

The glossy paper may be selected and ink drops having a small diameter may be used for the glossy paper. An ink jet printer which achieves a small variation of the dot diameter and quick drying of ink, even for a type of paper having a small capacity for absorbing ink can be accordingly provided.

According to the second embodiment, the solid region and its outline are identified. However, the following processes are possible.

(1) According to the pseudo level representation, image data is converted to dot diameter data and the resultant one is separated into respective colors of YMCK to be stored in the memory.

(2) A dot having the maximum dot diameter within the image data stored is identified. If those dots surrounding the dot of the maximum diameter all have the same color and the maximum dot diameter, the diameter is replaced with the one smaller by one rank or two ranks.

According to the third embodiment, the portion where a plurality of colors overlap is identified and the dot diameter for the identified portion is converted. However, the following processes may be carried out.

(1) According to the pseudo level representation, image data is converted to dot diameter data and the resultant one is separated into YMCK respectively and stored in the memory.

(2) A dot having the maximum dot diameter within the image data stored is identified. If a dot having a different color and the maximum dot diameter is present at the same location, the diameters of the dots of respective colors are replaced with the ones smaller by one rank or two ranks respectively.

According to the first embodiment, the dot diameter is converted to the one appropriate for each recording media after the pseudo level representation. However, any conversion appropriate for each recording media may be carried out in the process such as any gray level conversion, color conversion or the like in the image processing prior to the pseudo level representation, and a dot having a proper diameter for the recording media can be output.

For example, plural kinds of look up tables used for conversion according to the type of sheet may be stored and a table appropriate for the type of sheet may be selected in the gray level conversion process. Further, a conversion appropriate for a sheet (media) can be carried out in those processes of spatial filtering, color conversion, UCR and gray level conversion.

If an amount of ink emitted for printing one dot is controlled after the image processing, the image processing is carried out only once to simplify the process. For example, only one scheme for dealing with the sneak noise in the error diffusion process is necessary. If the dither method is employed, only one kind of look up table is used to reduce the number of memories.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet printing apparatus which can control an amount of ink emitted from a nozzle, the apparatus comprising:

a setter for setting a type of recording media on which print is made; and a controller for controlling an amount of ink emitted from said nozzle according to said setting, wherein image data supplied to the ink jet printing apparatus to effect an emission of ink is represented by a prescribed gradient(s), and wherein said controller is adapted to control the amount of ink emitted from said nozzle by modifying said prescribed gradient(s).

2. An ink jet printing apparatus according to claim 1, wherein said controller is adapted to decrease the amount of ink emitted from said nozzle if a set recording media is of a type where ink adhering to the set recording media does not readily dry.

3. An ink jet printing apparatus according to claim 1, wherein said controller modifies the prescribed gradient(s) so as to reduce an otherwise prescribed amount of ink emitted if a set recording media is of a type where ink adhering to the set recording media does not readily dry.

4. An ink jet printing apparatus according to claim 1, wherein said controller is adapted to decrease the amount of ink by reducing a number of ink drops emitted from said nozzle for a prescribed print area.

5. An ink jet printing apparatus according to claim 1, wherein said ink jet printing apparatus includes a plurality of nozzles having different sizes, and the amount of ink is controlled by using said plurality of nozzles to respectively emit ink drops of different sizes.

6. An ink jet printing apparatus which can control an amount of ink emitted from at least one nozzle onto a recording media to form an image representative of supplied image data, said ink jet printing apparatus comprising:

a detector for detecting a solid region included in an image to be printed; and a controller for controlling an amount of ink emitted from said at least one nozzle for a portion to be printed within said solid region, wherein supplied image data is represented by a prescribed gradient(s), and the controller is adapted to control the amount of ink emitted from said at least one nozzle by modifying the prescribed gradient(s).

7. An ink jet printing apparatus which can control an amount of ink emitted from a plurality of nozzles onto a recording media to form an image representative of supplied image data, said ink jet printing apparatus comprising:

a detector for detecting a solid region included in an image to be printed; and a controller for controlling an amount of ink emitted from said plurality of nozzles for a portion to be printed within said solid region, wherein the amount of ink is controlled by using said plurality of nozzles to respectively emit ink drops of different sizes so as to reduce an overall volume of ink needed to form said portion while maintaining respective proportion(s) of ink color(s) forming said portion.

8. An ink jet printing apparatus which can control an amount of ink emitted from at least one nozzle, said ink jet printing apparatus comprising:

a detector for detecting, in image data to be printed, a portion where a plurality of colors of ink is to desirably overlap in a corresponding printed image, the portion is formed by a prescribed amount of ink in accordance with the image data; and a controller for reducing the prescribed amount of ink emitted from said at least one nozzle for the portion detected by said detector while maintaining respective color proportions of the plurality of colors of ink.

9. An ink jet printing apparatus according to claim 8, wherein image data supplied to the ink jet printing apparatus to effect an emission of ink is represented by a prescribed gradient(s), and said controller is adapted to control the amount of ink emitted from said at least one nozzle by modifying said prescribed gradient(s).

10. An ink jet printing apparatus according to claim 8, wherein said controller is adapted to decrease the amount of ink emitted from said at least one nozzle for recording a portion detected by said detector.

11. An ink jet printing apparatus according to claim 8, wherein said controller is adapted to decrease the amount of ink by reducing a number of ink drops emitted from said at least one nozzle for recording a portion detected by said detector.

12. An ink jet printing apparatus according to claim 8, wherein said ink jet printing apparatus includes a plurality of nozzles having a prescribed number of sizes, and said controller adjusts flow of said ink by using said plurality of nozzles to emit ink drops of different sizes.

13. An ink jet printing apparatus which can control an amount of ink emitted from at least one nozzle onto a recording media when printing a number of ink drops in accordance with image data having at least one gradient level, said ink jet printing apparatus comprising:

a determiner for determining readiness of drying of ink on recording media; and a controller for controlling an amount of ink emitted from said at least one nozzle by converting said at least one gradient level of image data to another gradient level based on a readiness of drying of ink determined by said determiner.

14. An ink jet printing apparatus according to claim 13, wherein said determiner determines a type of recording media.

15. An ink jet printing apparatus according to claim 13, wherein said determiner determines a characteristic of a region where an image is to be printed.

16. An ink jet printing apparatus according to claim 15, wherein said determiner determines whether said region is to be printed as a solid region.

17. An ink jet printing apparatus according to claim 15, wherein said determiner determines if said region is a region where a plurality of colors are to be overlapped.

18. An ink jet printing apparatus according to claim 13, wherein said controller decreases the amount of ink emitted from said at least one nozzle when it is determined that said ink does not readily dry.

19. An ink jet printing apparatus according to claim 13, wherein said controller controls the amount of ink by reducing a number of ink drops emitted from said at least one nozzle for a prescribed print area.

20. An ink jet printing apparatus according to claim 13, wherein said at least one nozzle includes a plurality of nozzles having a prescribed number of nozzle sizes, and the amount of ink is controlled by using said plurality of nozzles to respectively emit ink drops of different sizes.

21. A method of controlling printing by an ink jet printing apparatus which can control an amount of ink emitted from at least one nozzle onto a recording media when printing a number of ink drops in accordance with image data having at least one gradient level, said method comprising:

determining an ink drying readiness for a recording media; and controlling an amount of ink emitted from said at least one nozzle by converting, in accordance with said step of determining, an image data gradient of image data of an image to be printed to another gradient level.

22. A method of controlling printing according to claim 21, wherein said step of determining includes determining a type of said recording media.

23. A method of controlling printing according to claim 21, wherein said step of determining includes determining a characteristic of a region of an image to be printed.

24. A method of controlling printing according to claim 21, wherein said step of controlling includes controlling the amount of ink from said at least one nozzle by emitting ink drops having a size according to a converted image data gradient.

25. A method of controlling printing according to claim 21, wherein said step of controlling includes controlling the amount of ink by changing a number of dots to be printed according to a converted image data gradient.

26. A method of controlling printing according to claim 21, wherein said ink jet printing apparatus includes a plurality of nozzles having a prescribed number of nozzle sizes, and wherein said step of controlling includes controlling the amount of ink by emitting ink drops of different sizes from said plurality of nozzles.

27. An ink jet printer that can control an amount of ink emitted from a nozzle, said ink jet printer comprising:

a controller for controlling an amount of ink emitted from said nozzle based on image data gradients of image data to be printed, each image data gradient being representative of a prescribed printed ink dot size, wherein said controller is adapted to decrease the amount of ink emitted from said nozzle in accordance with image data corresponding to a plurality of colors of ink to be overlapped when printed, such decrease in the amount of emitted ink effects a smaller printed ink dot size relative to a corresponding prescribed printed ink dot size for any given image data gradient.

28. An ink jet printer that can control an amount of ink emitted from a nozzle, said ink jet printer comprising:

a controller for controlling an amount of ink emitted from said nozzle based on image data gradients of image data to be printed, each image data gradient being representative of a prescribed printed ink dot size, wherein said controller is adapted to decrease an amount of an emitted colored ink that is included within a plurality of colors of ink to be overlapped when printed, such decrease in the amount of emitted colored ink effects a smaller printed ink dot size relative to a corresponding prescribed printed ink dot size for any given image data gradient.

29. An ink jet printer according to claim 28, wherein said controller is adapted to decrease all of said plurality of colors of ink to be overlapped when printed.

30. An ink jet printer according to claim 29, wherein said plurality of colors of ink include a cyan ink, a magenta ink, and a yellow ink.

* * * * *